United States Patent [19]

Pelt et al.

[11] 4,291,854

[45] Sep. 29, 1981

[54] RAIL SYSTEM HAVING WHEEL-ENGAGED HYDRAULIC PISTON-AND-CYLINDER ASSEMBLY, AND SUCH AN ASSEMBLY

[75] Inventors: Cornelis P. Pelt; Hendrikus De Jong, both of Castricum, Netherlands

[73] Assignee: Hoogovens Ijmuiden, B.V., Ijmuiden, Netherlands

[21] Appl. No.: 91,342

[22] Filed: Nov. 5, 1979

[30] Foreign Application Priority Data

Nov. 15, 1978 [NL] Netherlands ..... 7811280

[51] Int. Cl.[3] ..... B61L 1/00; B61L 11/06

[52] U.S. Cl. ..... 246/271; 246/361

[58] Field of Search ..... 104/147 R; 246/361, 246/270 R, 270 A, 271

[56] References Cited

U.S. PATENT DOCUMENTS 1,042,812 10/1912 Mitchell et al. ..... 246/361

1,497,336 6/1924 Kennedy ..... 246/271

1,545,232 7/1925 Buttrick ..... 246/271

FOREIGN PATENT DOCUMENTS 428799 4/1911 France .

9664 of 1914 United Kingdom .

*Primary Examiner*—Richard A. Bertsch

*Attorney, Agent, or Firm*—Stevens, Davis, Miller & Mosher

[57] ABSTRACT

In a rail system one or more hydraulic assemblies comprising a movable cylinder (6) with a wheel-engaged rounded head (7) and a fixed piston (4) within the cylinder (6) are located adjacent a running rail (1). When engaged by passing rail wheels (2) the assembly provides pressurized fluid which is fed into a pressure line which leads to means for switching a set of points. Energy is thus extracted from moving rail vehicles and it is unnecessary to provide long-distance power supplies to a set of points.

8 Claims, 2 Drawing Figures

RAIL SYSTEM HAVING WHEEL-ENGAGED HYDRAULIC PISTON-AND-CYLINDER ASSEMBLY, AND SUCH AN ASSEMBLY

BACKGROUND OF THE INVENTION

1. FIELD OF THE INVENTION

The invention relates to a rail system for vehicle transport and in particular a rail system having one or more wheel-engaged hydraulic piston-and-cylinder assemblies located next to a running rail. At the same time the invention relates to a hydraulic piston-and-cylinder assembly which is suitable for use in this rail system.

2. DESCRIPTION OF THE PRIOR ART

Rail systems having such piston-and-cylinder assemblies are used for decelerating and for accelerating rail vehicles. In a fixed cylinder there is a movable piston having a mushroom-shaped head, and the assembly is connected to a source of fluid pressure.

If a vehicle is to be decelerated, the piston is forced by fluid pressure outwards in the upwards direction, so that a passing rail-wheel is forced to press the piston inwards against back-pressure. The energy which thus has to be exerted on the pressurizing fluid is extracted from the kinetic energy of the vehicle, which as a result is decelerated. As a rule, in known installations, several such hydraulic cylinders are connected one after the other to a rail. It is also known to actuate the cylinders whilst and after a rail wheel is passing the piston head, so that acceleration is imparted to the wheel. In both these two known applications of such rail systems, liquid is supplied under pressure to the cylinders with the aim of influencing the movement of a rail vehicle.

SUMMARY OF THE INVENTION

The present invention is based on a completely new concept for using the hydraulic cylinders of such a rail system. According to the invention the hydraulic piston-and-cylinder assembly acts as a pressure cylinder which is actuated by a passing wheel to provide pressurized fluid and is connected to a pressure line which supplies pressurized fluid to means for switching a set of rail points can be hydraulically actuated. In this case the hydraulic assembly is not actuated or driven by the pressurized liquid, but is employed as a high-pressure liquid pump for actuating a points setting device. A set of points is also called a switch. Here the former term will be used, or for short just the word "points".

It should be pointed out that generally rail points are provided with manual or electrical switching means. In comparison with manually actuated points switching arrangements, the system of the invention offers clear ergonomic advantages, by making available a new external source of power which renders manual labour superfluous for switching. Manual labour for this purpose can of course also be rendered superfluous by employing electrically operated points switching means, but as compared with the system of the invention these give rise to clear difficulties. With the new system the power for switching is supplied on site by rail vehicles, so that the supply of energy over a long distance becomes unnecessary. This means that savings can be made in expensive, sensitive electrical cabling leading to the points.

It is thus one object of this invention to provide an improved design of rail system including a wheel-engaged hydraulic assembly, and another object of the invention to simplify the provision of power to points switching means.

A design of the hydraulic assembly, modified as compared with known designs is preferable when this assembly is used as a high-pressure liquid pump as proposed by this invention. In this new design, the cylinder is movable relative to a fixed piston located within it, the pressurizing chamber being between the endface of the piston and a closed end of the cylinder. A bore through the piston may be provided for inflow and/or outflow of the fluid. A fixed external cylindrical member may be provided outside the movable cylinder e.g. for guidance. Naturally in this case the movable internal cylinder may be suitably provided at its top closed end with a mushroom-shaped head. In this way it is possible without major difficulties and without danger of liquid leakage to build up pressures to 100–130 bar.

Naturally it is possible to so dimension and so locate the hydraulic cylinders that during each passage of a vehicle over the incoming track towards a points, sufficient energy is supplied to set these points in good time. However, greater flexibility is achieved if the hydraulic assembly is connected via non-return valves to a low-pressure line and to the high-pressure line, and if a pressure accumulator is connected to the high-pressure branch. Then on each occasion when a vehicle passes, energy can be supplied to the accumulator, from which it can be extracted as required at the time when it is necessary to change the points. In this connection it should be noted that pressure accumulators are design elements which are generally known, and which can for example be supplied in the form of a pressure vessels having an elastic gas-spring.

Furthermore it is recommended that a plurality of the hydraulic piston-and-cylinder assemblies are connected hydraulically in parallel and are arranged one after the other along the same rail. This provides increased freedom as regards the dimensioning of the cylinders, whilst at the same time more pressure energy can be provided for example for the switching of several sets of points.

It is of course feasible to arrange the hydraulic assembly or assemblies on the track approaching the points. It is also however possible for the assembly or assemblies to be arranged on the most densely trafficked track in the vicinity of the points being switched which are on another track, whilst it is also possible to use the energy produced for switching several points located close to each other.

Apart from the rail system described, the invention also relates to the hydraulic assembly described which is suitable for use in this rail system.

BRIEF INTRODUCTION OF THE DRAWINGS

An embodiment of the invention will be described below by way of non-limitative example with reference to the accompanying diagrammatic drawing in which.

DESCRIPTION OF THE PREFERRED EMBODIMENT

Figure 1:
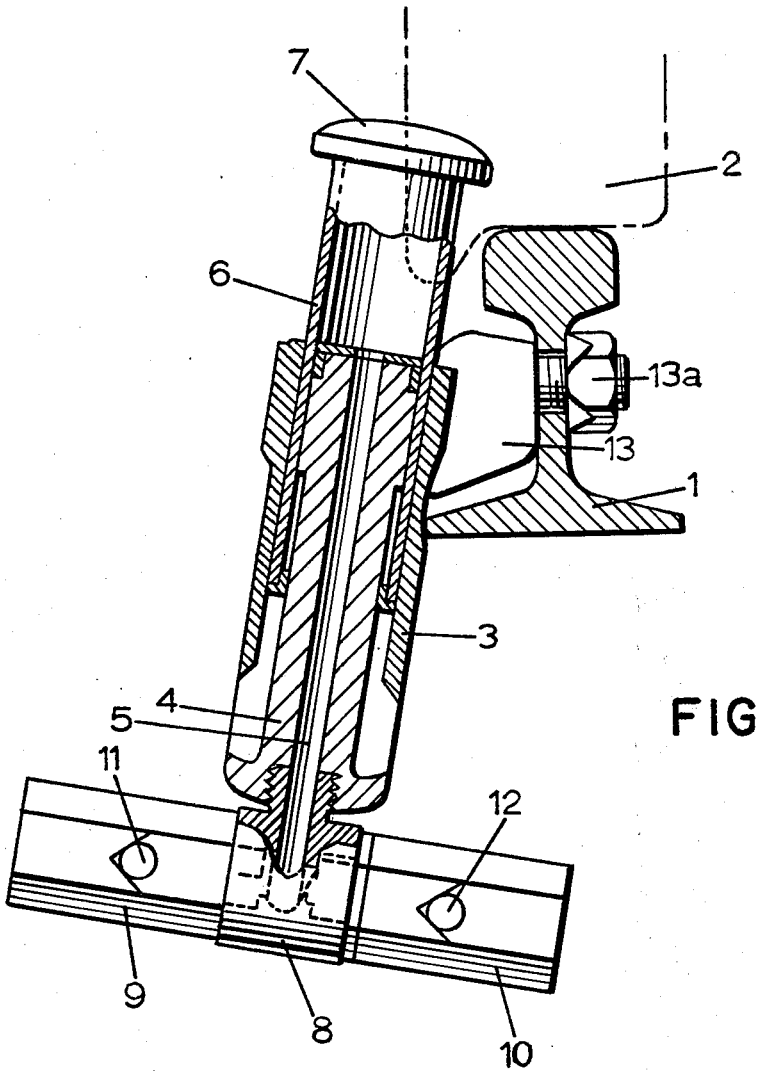
FIG. 1 illustrates a hydraulic assembly embodying the invention, shown schematically and in partial longitudinal section, fastened to a rail.

FIG. 1 shows a rail 1 and a wheel profile 2 running on the rail 1 and shown by a chain-dotted line.

An external cylinder 3 of the hydraulic assembly is fastened to the rail by fastening means 13 and a nut 13*a*. Inside the external cylinder 3 there is a fixed piston 4 which is provided with an axial central drilled bore 5. A cylinder 6 can move freely in the space between the external cylinder 3 and piston 4. At its top end the movable cylinder 6 is closed by a mushroom-shaped head 7. When a wheel 2 passes along the rail 1 and passes the assembly, the wheel flange presses the head 7 downwards, so that the pressurizing space between the internal wall of the head 7 of the cylinder 6 and the end face of the piston 4 is reduced, to compress fluid in that space.

Via a coupling 8, the bore 5 is connected to a low pressure pipeline 9 and a high-pressure pipeline 10. In these pipelines 9 and 10 there are non-return valves 11 and 12. After the wheel 2 has passed, liquid under pressure is supplied at a low positive pressure via the low pressure pipeline 9, the non-return valve 11, the coupling 8 and the bore 5 to the space inside the cylinder 6, as a result of which the latter moves outwards to its extreme position in which a rim at the free end of the cylinder 6 engages a rim on the piston 4. While the head 7 is being depressed, the non-return valve 11 is closed and non-return valve 12 is opened, as a result of which liquid under high pressure is discharged into the high pressure pipeline 10.

Figure 2:
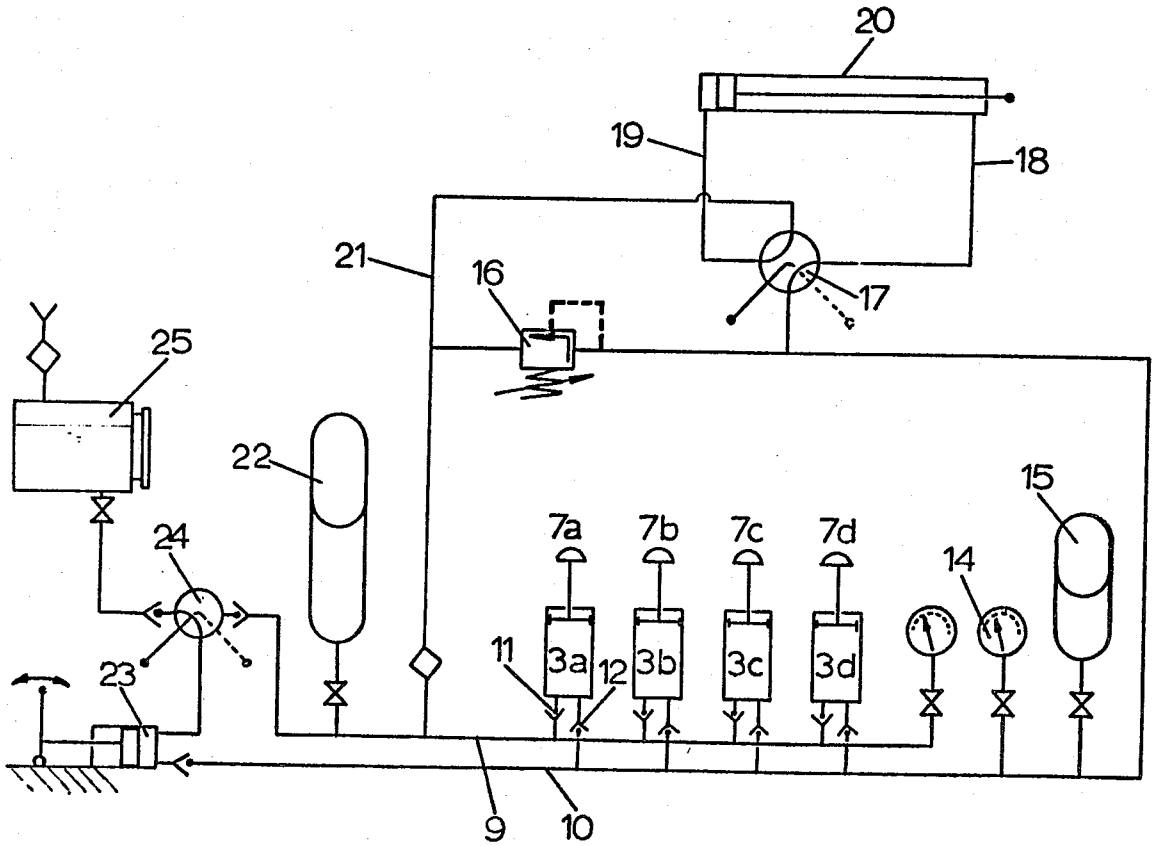
FIG. 2 is a schematic diagram of a system embodying the invention in which four hydraulic assemblies are used for actuating a points.

FIG. 2 schematically shows four of the assemblies shown in FIG. 1, numbered 3*a*, 3*b*, 3*c* and 3*d*. The high-pressure pipeline 10 is connected to a manometer 14 and also to a pressure accumulator 15 and an overflow valve 16. The pressure accumulator is of a known type in which a nitrogen filled elastic gas-spring is incorporated in a pressure vessel. The overflow valve 16 is of the spring-loaded type and is so adjusted that liquid under pressure can overflow and return to the low pressure side 9 if a liquid pressure of 130 bar is exceeded. The liquid under pressure can be supplied via a changeover valve 17 to one or other of the two sides of a servo-cylinder 20, via pipeline 18 or pipeline 19. This servo-cylinder is in turn connected to a set of points (not shown). Thus by changing the valve 17 it is possible to switch the points. The liquid on the non-pressurized side of the servo-cylinder 20 flows away via a pipeline 21 to the low-pressure pipeline 9.

FIG. 2 also shows schematically how the supply of liquid to the low-pressure pipeline 9 is carried out and how, during start-up of the system, pressure can be imparted to the high-pressure pipeline 10 before a rail vehicle has passed. A low-pressure accumulator 22 is connected to the pipeline 9 and this accumulator can be filled via the changeover valve 24 from a supply 25. To start up the installation, the changeover valve 24 is switched so that liquid can be extracted from the storage vessel 25 into a hand-actuated pressure cylinder 23, which is used to pump the liquid under high pressure into the pipeline 10.

In the embodiment shown the hydraulic cylinders 3 are so dimensioned that the cylinder 6 during the passage of a wheel 2, has a stroke volume of about 140 $cm^3$. Use can be made of a high-pressure accumulator 15 with an available liquid volume of 10 liters, and this accumulator can store liquid at a pressure which varies from 100 to 125 bar. This is achievable by arranging for opening of the overflow valve 16 at an overflow pressure of 130 bar. The servo-cylinder 20 is designed for a stroke volume of about 400 $cm^3$. The low-pressure accumulator is a vessel with a volume of about 50 liters, and its gas-spring can permit a preliminary pressure of 10 bar in the liquid.

What is claimed is:

1. A rail system for vehicle transport having
(a) a rail track of spaced apart parallel rails,
(b) a set of points,
(c) hydraulically operated means for switching said set of points,
(d) a hydraulic piston-and-cylinder assembly located next to one of said rails of said rail track and having an element projecting into the path of the rail wheels of a rail vehicle passing on said track to be engaged thereby so that the said assembly is actuated by passage of a rail vehicle to provide pressurised fluid, and
(e) a pressure line connecting said piston-and-cylinder assembly to said points switching means whereby said pressurised fluid from the assembly is usable to operate the points switching means.

2. A rail system according to claim 1 having a plurality of said hydraulic piston-and-cylinder assemblies arranged one after another along said rail of the rail track and connected hydraulically in parallel to said pressure line.

3. A rail system according to claim 1 or claim 2 wherein the said element of the piston-and-cylinder assembly engaged by the rail wheels is an externally rounded head of a movable cylinder of the assembly, there being a fixed piston located within said cylinder, with a pressurising chamber located between said piston and said rounded head of the cylinder.

4. In a rail system for vehicle transport having a hydraulic piston-and-cylinder assembly located next to a rail and arranged to be actuated by the rail wheels of a passing vehicle, the improvement that the piston-and-cylinder assembly is adapted and arranged to provide pressurised hydraulic fluid on being actuated by a passing wheel and the assembly is connected to a pressure line for supply of said pressurised fluid from the assembly to means for switching a set of rail points.

5. A rail system according to claim 4 wherein the piston-and-cylinder assembly has a movable cylinder closed at one end and a fixed piston within the cylinder, the fluid being compressed in the space between the said closed end of the cylinder and the end face of the piston, there being a bore through the piston for outflow of the pressurised fluid to the pressure line.

6. A rail system according to claim 4 or claim 5 wherein the piston-and-cylinder assembly is connected by non-return valves respectively to the said pressure line and to a fluid supply line, an accumulator for pressurised fluid being connected to the pressure line.

7. A rail system according to claim 4 or claim 5 wherein a plurality of said piston-and-cylinder assemblies are arranged one after another along the said rail and connected hydraulically in parallel to the said pressure-line.

8. A hydraulic piston-and-cylinder assembly for use in a rail system according to one of claims 2 or 4 having a movable cylinder having one end closed by an externally rounded head adapted to be engaged by rail wheels, a stationary piston within said cylinder having an end face opposed to said head of the cylinder whereby a pressurising chamber is formed in said cylinder between said head and the end face of the piston, and outside said cylinder a stationary external cylindrical member within which said cylinder moves, the piston having at least one bore through it for fluid supply to and fluid discharge from the said pressurising chamber.

* * * * *